US005484381A

United States Patent [19]

Potter

[11] Patent Number: 5,484,381

[45] Date of Patent: Jan. 16, 1996

[54] CENTRIFUGE ROTOR HAVING LIQUID-CAPTURING HOLES

[75] Inventor: Raymond G. Potter, Southbury, Conn.

[73] Assignee: E. I. Du Pont de Nemours and Company, Wilmington, Del.

[21] Appl. No.: 329,343

[22] Filed: Oct. 26, 1994

[51] Int. Cl.[6] ..... B04B 7/06; B04B 5/02

[52] U.S. Cl. ..... 494/12; 494/16

[58] Field of Search ..... 494/12, 16, 20, 494/33, 81, 85

[56] References Cited

U.S. PATENT DOCUMENTS

| | | | |
|---|---|---|---|
| 3,901,434 | 8/1975 | Wright | 494/16 |
| 3,970,245 | 7/1976 | Aeschlimann | 494/16 X |
| 4,372,483 | 2/1983 | Wright | 494/16 |
| 4,484,906 | 11/1984 | Strain | 494/16 |
| 5,071,402 | 12/1991 | Weyant, Jr. | 494/16 |
| 5,279,538 | 1/1994 | Carson | 494/81 |

FOREIGN PATENT DOCUMENTS

| | | | |
|---|---|---|---|
| 3334655 | 4/1985 | Germany | 494/16 |
| 1369812 | 1/1988 | U.S.S.R. | 494/16 |

OTHER PUBLICATIONS

Hereaus Christ Catalog HC–E Nov. 1.

*Primary Examiner*—Charles E. Cooley

[57] ABSTRACT

A rotor adapted for use in a nonevacuated chamber has a liquid containment annulus having a capacity $V_C$. The rotor also has a predetermined number N of liquid-capturing holes, each hole being sized and inclined such that it is able to capture therein a predetermined volume $V_H$ of liquid that may escape from a container while the rotor is rotating. At least some portion of the mouth of each hole lies radially outboard of a circular locus defined by corresponding points on each of a plurality M of container-receiving cavities in the rotor. The number N of holes and the volume $V_H$ of each hole satisfies the relationship:

$$N \cdot V_H + V_C \geqq n \cdot V_R$$

where n is an integer less than or equal to M and $V_R$ is the volume of liquid which is liberated in the event of rupture of the container received in a cavity.

3 Claims, 3 Drawing Sheets

CENTRIFUGE ROTOR HAVING LIQUID-CAPTURING HOLES

BACKGROUND OF THE INVENTION

1. Field of the Invention

The present invention relates to a centrifuge rotor having a plurality of liquid-capturing holes therein, the holes being arranged to capture a predetermined volume of liquid that may be liberated in the event of a container rupture.

2. Description of the Prior Art

A centrifuge rotor is a relatively massive member used within a centrifuge instrument to expose a liquid sample to a centrifugal force field. The rotor is provided with a plurality of cavities. The cavities may incline at a predetermined angle with respect to the rotor's axis of rotation, or may be oriented so that the axis of the cavity lies parallel to the axis of rotation. In the usual instance a container carrying a liquid sample is received within each of the cavities.

The container is subject to the risk of rupture during operation. In this event, depending upon the degree of inclination and the shape of the cavity, some or all of the, liquid sample carried by that container may escape from the cavity. If left unrestrained the liberated liquid may challenge the seal defined between the rotor and its associated lid, possibly exiting the rotor and entering the chamber of the centrifuge instrument. If the liquid is a biologically hazardous material its exit from the rotor is an especially catastrophic event.

Some prior art rotors attempt to forestall the exit of any liberated liquid from the interior of the rotor by disposing an annular lip about the periphery of the rotor body. The lip extends radially inward from the rim of the rotor and cooperates with the rim and the upper surface of the rotor body adjacent thereto to define an annular containment annulus. The containment annulus is sized to exhibit a containment capacity sufficient to hold an anticipated volume of liquid that may escape from a tube cavity in the event of rupture of one or more of the sample containers. Exemplary of rotors with a containment annulus defined by a containment lip are the rotors shown in Hereaus Christ catalog HC-E 11/1 dated April 1979. U.S. Pat. No. 4,372,483 (Wright) also illustrates a rotor with a containment lip. U.S. Pat. No. 5,071,402 (Weyant) shows a rotor having a containment lip and an arrangement of grooves disposed in surrounding relationship about the rotor cavities, with a bore being disposed in fluid communication with the grooves to expand the capacity thereof.

In the usual instance the provision of a suitably sized containment lip with a predetermined volumetric capacity is a sufficient response to the problem of liberated liquid. However, when a rotor is to be operated in a nonevacuated centrifuge instrument chamber (i.e., a chamber that contains some level of air pressure) a special problem with regard to containment of escaped liquid is presented. For such a rotor the direct expedient of providing a sufficiently sized containment annulus may not be available due to countervailing considerations regarding rotor windage.

Windage is the resistance, or friction, presented to a body as it is rotated or otherwise moved through air. In the context of a centrifuge instrument having a nonevacuated chamber, rotor windage is dependent upon the physical dimensions such as the diameter and/or height of the rotor as well as the size of the rotor with respect to the chamber in which it is disposed. Proximity of the rotor to the wall of the rotor chamber generates turbulent airflow that further increases air friction. Windage reduces rotor speed and, concomitantly, its performance for a given motor torque. Accordingly, it is not always possible merely to provide a containment annulus with a volumetric capacity sufficient to capture all the liquid expected to escape in the event of rupture of one or more of the containers in the rotor, as to do so may lead to a rotor that has physical dimensions (e.g., diameter and/or height) that would generate windage at a level sufficient to reduce the rotor speed and performance to an unacceptable level.

In view of the foregoing it is believed to be advantageous to provide a centrifuge rotor for use in a nonevacuated chamber that has a liquid containment capacity sufficient to capture and contain all of the liquid liberated within the rotor in the event of the rupture of one or more container(s), yet to do so in a way that maintains rotor performance, and reduces windage.

SUMMARY OF THE INVENTION

The present invention is directed to a centrifuge rotor adapted for rotation in a nonevacuated chamber about an axis of rotation. The rotor has a predetermined plurality M of cavities therein, each of which has a mouth. A point on the mouth of each cavity lies a predetermined maximum distance from the axis of rotation. The points of maximum distance define a circular locus. Each cavity is adapted to receive a container therein, with each container being sized to hold therein a predetermined volume of liquid. An axis extends through each cavity, the axis of the cavity being inclined at a predetermined angle with respect to the axis of rotation. The predetermined angle of inclination of the cavity defines a volume $V_R$ of liquid that is released from a container disposed in the cavity in the event of rupture of the container while the rotor is rotating. An arc having predetermined arcuate length S extends between the axes of two adjacent cavities. The rotor may optionally include an annular rim with a radially inwardly extending lip thereon, the rim and the lip cooperating to define a liquid containment annulus. If provided, the liquid containment annulus is sized to hold a predetermined volume $V_C$ of liquid therein while the rotor is rotating.

A rotor in accordance with the present invention includes a predetermined number N of liquid-capturing holes disposed in the rotor, with each liquid-capturing hole having an axis extending therethrough. The axis of each hole is inclined at a predetermined angle with respect to the axis of rotation. In the preferred instance each liquid-capturing hole is configured with a cylindrical portion and a spherical bottom portion. Each hole is sized and inclined such that each hole is able to capture therein a predetermined volume $V_H$ of liquid while the rotor is rotating.

The number N of holes and the volume $V_H$ of each hole satisfies the relationship:

$$N \cdot V_H + V_C \geqq n \cdot V_R$$

where n is an integer less than or equal to M. The term $V_C$ goes to zero if the containment annulus is not provided.

Each liquid-capturing hole is disposed between two adjacent cavities such that a radius extending from the axis of rotation to the axis of any one of the holes bisects the arc of length S between the cavities adjacent to that hole. Each of the liquid-capturing holes has a mouth thereon, with at least some portion of the mouth of each liquid-capturing hole lying radially outboard of the circular locus defined by the points of maximum distance.

BRIEF DESCRIPTION OF THE DRAWINGS

The present invention will be fully understood from following detailed description thereof, taken in connection with the accompanying drawings, which form apart of this application, and in which.

DETAILED DESCRIPTION OF THE INVENTION

Figure 1:
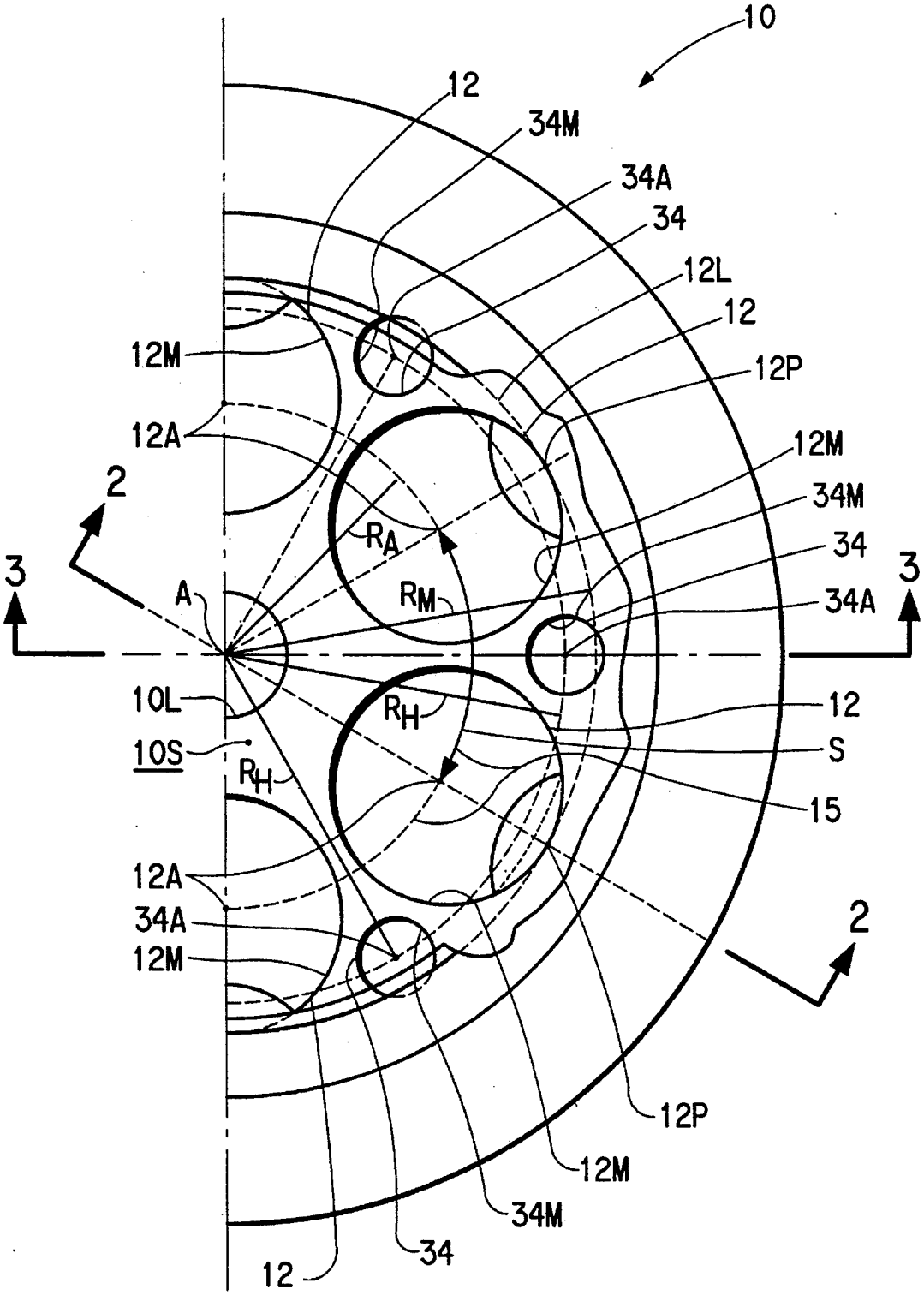
FIG. 1 is a plan view of a symmetric half of a centrifuge rotor having a predetermined number of liquid-capturing holes disposed therein in accordance with the present invention.

Throughout the following detailed description, similar reference numerals refer to similar elements in all Figures of the drawings.

FIG. 1 shows in plan view a symmetric half of a centrifuge rotor generally indicated by the reference character 10 that is adapted for rotation about an axis of rotation: A within a nonevacuated chamber (not shown) of a centrifuge instrument. The rotor 10 is a relatively massive member having a main body portion 10B with an upper surface 10S thereon. The rotor 10 is fabricated from a suitable material, such as an aluminum alloy, typically by forging and machining. The central portion of the rotor body 10B has a bore 10L extending centrally and axially therethrough by which the rotor 10 may be secured to the upper end of a drive spindle (not shown). If desired, the bottom of the rotor body 10B may be undercut, as at 10U, for purposes of both mass and inertia minimization.

The body 10B of the rotor 10 has a predetermined plurality of sample container-carrying cavities 12 therein. Any convenient number M of cavities 12 may be provided, dependent upon conditions such as the stress levels to which the rotor would be exposed and the size of the chamber in which rotor is used, available motor torque and centrifugal force field requirements. Each cavity 12 is suitably formed, as by boring, into the body 10B of the rotor 10. Each of the cavities 12 has a mouth 12M where the cavity 12 intersects the upper surface 10S of the rotor body 10B. A point 12P on each of the mouths 12M lies a predetermined maximum radial distance RM from the axis of rotation A. The collection of points 12P define a circular locus 12L centered on the axis of rotation A. Each cavity has an axis 12A extending therethrough. The axis 12A of the cavity is inclined at a predetermined angle 14 with respect to the axis of rotation A of the rotor. The points where the axes 12A of two adjacent cavities 12 intersect the surface 10S are connected by an arc 15 having a predetermined arcuate length S, with the radial distance from the axis of rotation A to the arc 15 being indicated by the reference character $R_A$.

Figure 2:
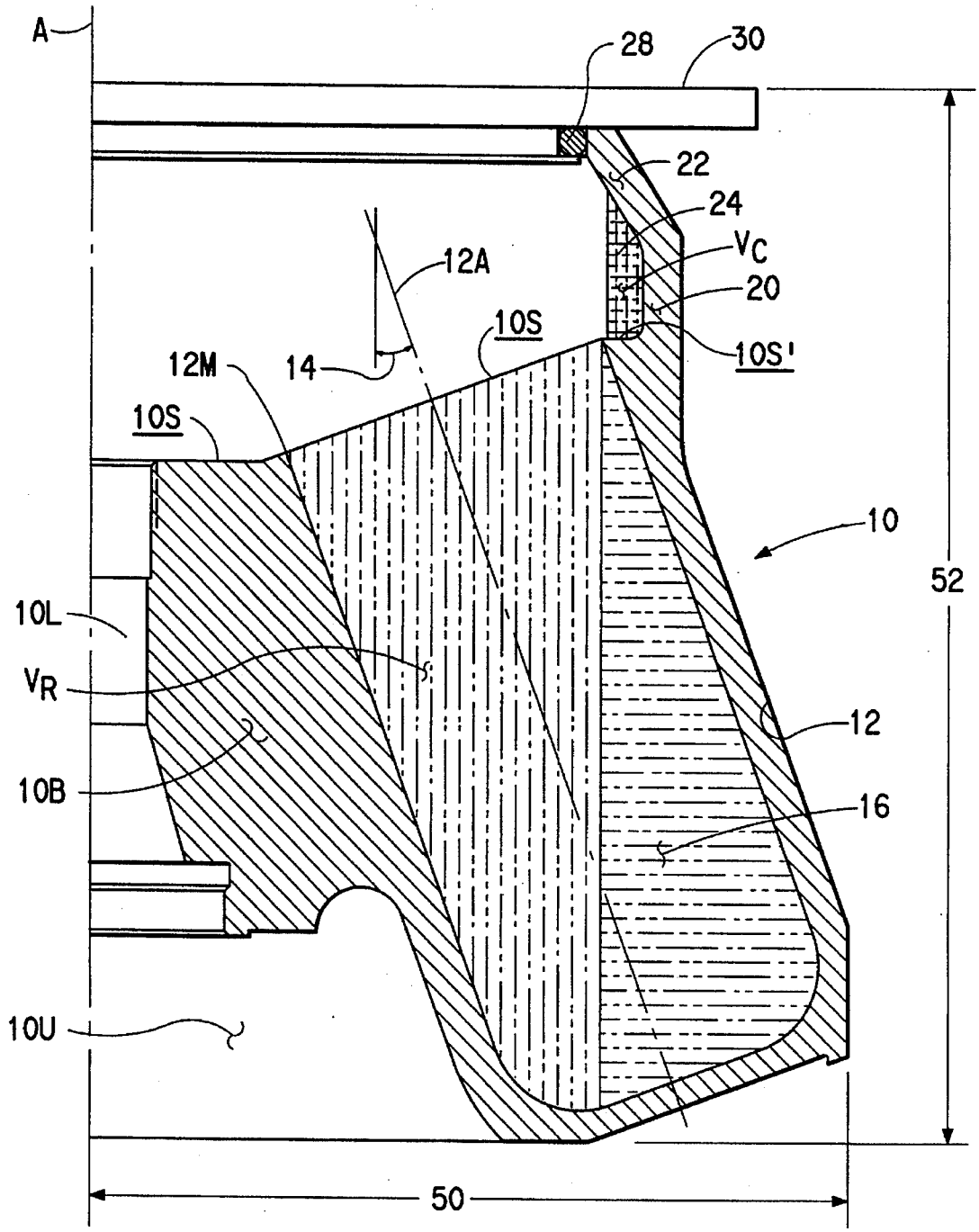
FIG. 2 is a sectional view taken along section lines 2—2 in FIG. 1 illustrating the structural arrangement of an inclined rotor cavity within the body of the rotor and the liquid containment capability afforded by the rotor cavity in the event of the rupture of a container disposed within the cavity while the rotor is being rotated.

Each cavity 12 is adapted to receive a container (not shown) therein. Each container is sized to hold a predetermined volume of liquid therein. If the container were to rupture during operation of the instrument liquid carried within the container would be released into the cavity 12. As seen in FIG. 2, owing to inclination of the axis 12A of the cavity 12 with respect to the axis of rotation A, the geometry of cavity 12 would itself serve to prevent at least a volume of liquid equal to the meniscus volume 16 (shown by horizontal dot-dash lines) from being able to escape from the cavity 12. However, since the volume of the container would likely exceed the capacity of the meniscus volume 16 some incremental volume $V_R$ of liquid would be released from a ruptured container and urged by centrifugal force to exit the cavity 12. This incremental volume $V_R$ of liquid that would be liberated in the event of a container rupture is illustrated in FIG. 2 by vertical dot-dash lines in the cavity 12.

The prior art solution to such a release of liquid is to provide the rotor 10 with an upstanding annular rim 20 disposed about the periphery of the rotor body 10B. The rim 20 has a radially inwardly extending lip 22 thereon. The rim 20 and the lip 22 cooperate with that portion 10S' of the surface 10S of the rotor 10 radially outboard of the cavities 12 to define a liquid containment annulus 24. The liquid containment annulus 24 is sized to hold a predetermined containment volume $V_C$ of liquid therein. The containment volume $V_C$ is illustrated by a combination of vertical and horizontal dot-dash lines. The containment annulus 24 prevents liquid captured thereby from challenging a seal 28 that is disposed in the undersurface of a lid 30. The lid 30 is received by the rotor 10 and secured thereto during rotor operation, as appreciated by those skilled in the art.

As discussed earlier, in designing a rotor for use in a nonevacuated instrument chamber windage effects impose practical limits on the dimensions, and therefore the containment volume $V_C$, of the containment annulus 24. As used herein the term "nonevacuated" refers to a centrifuge instrument chamber that contains air at atmospheric pressure, although the term should also be construed to encompass an instrument in which the chamber pressure is on the order of one (1) millibar or greater. Thus, for a rotor operating in a nonevacuated instrument chamber an expedient for capturing liberated liquid other than a commensurately sized containment annulus must be found.

Figure 3:
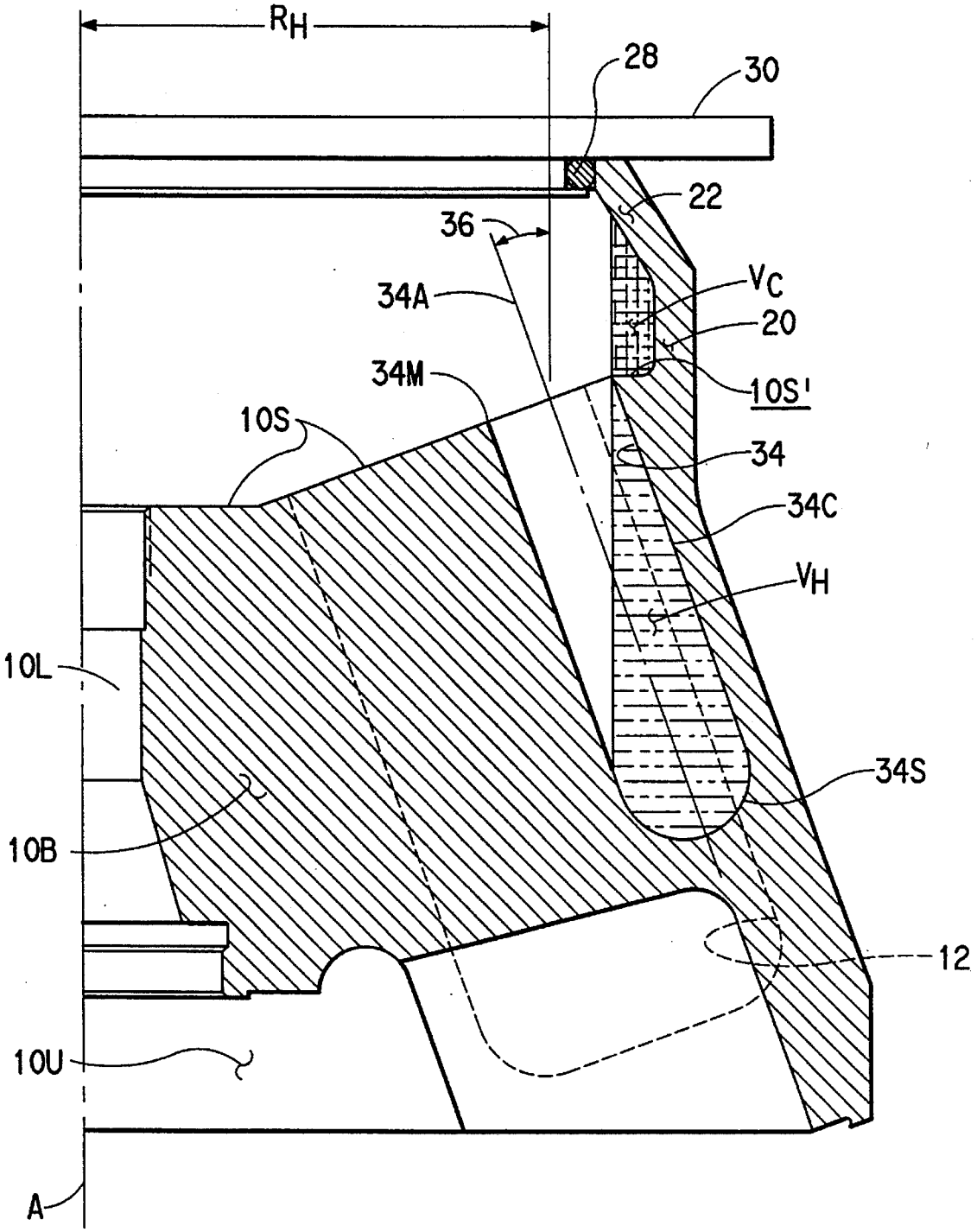
FIG. 3 is a sectional view taken along section lines 3—3 in FIG. 1 illustrating the structural arrangement and the liquid containment capability afforded by an inclined liquid-capturing hole disposed in the body of the rotor in accordance with the present invention.

In accordance with the present invention the rotor 10 is provided with a predetermined number N of liquid-capturing holes 34. In the preferred case the number N of liquid-capturing holes 34 equals the number M of container-carrying cavities 12, although such equality need not necessarily be the case. As best seen in FIG. 3 each liquid-capturing hole 34 has an axis 34A extending therethrough. The axis 34A of each hole 34 is inclined at a predetermined angle 36 with respect to the axis of rotation A. Each hole 34 is, in the preferred instance, configured with a cylindrical portion 34C and a spherical bottom portion 34S. Such a geometry makes possible fabrication of the holes 34 using conventional boring equipment. It should be understood that the holes could exhibit alternative geometries and be fabricated using alternative material removal techniques. Such alterative techniques include milling, laser removal or casting the rotor with the holes 34 already in place.

Each of the liquid-capturing holes 34 has a mouth 34M defined where the hole 34 intersects the surface 10S of the rotor 10. In accordance with this invention, as best seen in FIG. 1, at least some portion of the mouth 34M of each liquid-capturing hole 34 lies radially outboard of the circular locus 12L defined by the points of maximum distance 12P. Each liquid-capturing hole 34 is preferably, but not necessarily, disposed intermediate adjacent cavities 12 such that a radius RH extending from the axis of rotation A to the axis 34A bisects the arc 15 of length S between the axes 12A of the cavities 12 adjacent m that hole 34. One alterative construction for a hole 34 may utilize a pair of closely spaced openings provided in the region of the rotor intermediate adjacent cavities 12, with the radius $R_H$ extending through the web defined between such openings. If a lip 22 is provided at least some portion of the mouth of the hole 34 (however constructed) should communicate with the containment annulus defined by that lip.

In accordance with the present invention each hole 34 is sized and inclined such that, while the rotor is rotating, the hole 34 is able to capture therein a predetermined volume $V_H$ of liquid. The volume $V_H$ is indicated in FIG. 3 by horizontal dot-dash lines.

In accordance with the present invention the number N of holes 34 and the volume $V_H$ of liquid able to be captured by each hole satisfies the relationship:

$$N \cdot V_H + V_C \geqq n \cdot V_R. \quad (1)$$

where n is an integer less than or equal to M, the number of cavities disposed in the rotor. Any convenient value for the integer n may be chosen.

With a rotor 10 having the liquid-capturing holes 34 in accordance with the present invention liquid released as a result of the rupture of a container is totally contained within the rotor 10 without challenge to the seal 28. As a result a containment lip 22 need not be relied upon as the sole structural feature that serves to contain released liquid. In fact, if consistent with the stress levels to which the rotor would be exposed, an appropriate number N of appropriately sized holes 34 (of whatever configuration) could be formed in the rotor body 10B sufficient to contain at least the volume of liquid that would be released in the event of rupture of some number n of containers, then the lip 22 and the containment capacity $V_C$ afforded thereby may be minimized or eliminated. In such a circumstance (elimination of the lip 22) the number N of holes 34 and the volume $V_H$ of liquid able to be captured by each hole would satisfy the relationship:

$$N \cdot V_H \geqq n \cdot V_R. \quad (1A)$$

where n is an integer less than or equal to M, the number of cavities disposed in the rotor.

As a further consequence of the use of the liquid-capturing holes 34, together with the minimization or elimination of the lip 22, the diameter and/or height dimension(s) of the rotor 10 may be chosen to reduce windage effects. Moreover, it should also be apparent that removal of material from the rotor to form the liquid-capturing holes also serves to reduce the mass, and therefore, the inertia of the rotor. The reduction in inertia and mass improves rotor acceleration and/or deceleration. The reduced mass makes the rotor easier to handle.

EXAMPLE

The present invention may be more fully and clearly understood from the following specific example.

A rotor in accordance with the present invention was constructed from an aluminum alloy and machined to provide six cavities (M=6). The rotor was designed to operate in a nonevacuated chamber at a rotational speed on the order of twelve thousand revolutions per minute (12,000 rpm). Each cavity was inclined at twenty degrees (angle 14=20°) and each cavity was sized to accept a five hundred milliliter (500 ml) container ($V_R$ plus the volume 16). The incremental volume of liquid that would be released from each cavity in the event of rupture of the container received therein (the liberated volume $V_R$) was three hundred fifty milliliters (350 ml). The rotor had a rim 20 with a lip 22 which defined a containment annulus 24 having a containment volume (volume $V_C$) of two hundred fifteen milliliter (215 ml). The rotor had six liquid-capturing holes 34 (N=6). Each hole was inclined at twenty degrees (angle 36=20°) and each hole was sized to hold twenty-two and one-half milliliters (22.5 ml) (the volume $V_H$). Thus, the rotor satisfied Equation (1) with the integer n being selected to equal one (n=1). Provision of the liquid-capturing holes 34 permitted the rotor to exhibit a maximum radius dimension (see, reference character 50, FIG. 2) of 6.23 inches and a height dimension (see, reference character 52, FIG. 2) of 9.1 inches.

Those skilled in the art, having the benefits of the teachings of the present invention as set forth herein, may effect numerous modifications thereto. Such modifications are to be construed as lying within the contemplation of the present invention as defined by the appended claims.

What is claimed is:

1. A centrifuge rotor adapted for rotation in a nonevacuated chamber about an axis of rotation, the rotor having a predetermined plurality M of cavities therein, each of the cavities having a mouth, each mouth having a point thereon that lies a predetermined maximum distance from the axis of rotation, the points of maximum distance defining a circular locus centered on the axis of rotation, each cavity being adapted receive a container therein, each container being sized to hold a predetermined volume of liquid therein, each cavity having an axis extending therethrough, the axis of each cavity being inclined at a predetermined angle with respect to the axis of rotation, the predetermined angle of inclination of each cavity defining a volume $V_R$ of liquid that is released from a single container in the event of rupture thereof during rotation of the rotor, wherein an arc extending between the axes of two adjacent cavities has a predetermined arcuate length S, wherein the improvement comprises:

a predetermined number N of liquid-capturing holes disposed in the rotor, each liquid-capturing hole being configured with a cylindrical portion and a spherical bottom portion each liquid-capturing hole having an axis extending therethrough, the axis of each hole being inclined at a predetermined angle with respect to the axis of rotation, each hole being sized and inclined such that each hole is able to capture therein a predetermined volume $V_H$ of liquid while the rotor is rotating, each of the liquid-capturing holes having a mouth thereon, at least some portion of the mouth of each liquid-capturing hole lying radially outboard of the circular locus defined by the points of maximum distance, the number N of holes and the volume $V_H$ of each hole satisfying the relationship:

$$N \cdot V_H \geqq n \cdot V_R,$$

where n is an integer less than or equal to M, each liquid capturing hole being disposed between two adjacent cavities such that a radius extending from the axis of rotation to the axis of any one of the holes bisects the arc of length S between the cavities adjacent to said one of the holes.

2. A centrifuge rotor adapted for rotation in a nonevacuated chamber about an axis of rotation, the rotor having a predetermined plurality M of cavities there, each of the cavities having a mouth, each mouth having a point thereon that lies a predetermined maximum distance from the axis of rotation, the points of maximum distance defining a circular locus, each cavity being adapted to receive a container therein, each container being sized to hold a predetermined volume of liquid therein, each cavity having an axis extending therethrough the axis of the cavity being inclined at a predetermined angle with respect the axis of rotation, the predetermined angle of inclination of each cavity defining a volume $V_R$ of liquid that is released from a single container in the event of rupture thereof during rotation of the rotor, wherein an arc extending between the axes of two adjacent cavities has a predetermined, arcuate length S, the rotor having annular rim with a radially inwardly extending lip thereon, the rim and the lip cooperating to define a liquid containment annulus, the liquid containment annuls being sized to hold a predetermined volume $V_C$ of liquid therein while the rotor is rotating, wherein the improvement comprises:

a predetermined number N of liquid-capturing holes disposed in the rotor, each liquid-capturing being configured with a cylindrical portion and a spherical bottom portion, each liquid-capturing hole having an axis extending therethrough, the axis of each hole being inclined at a predetermined angle with respect to the axis of rotation, each hole being sized and inclined such that each hole is able to capture therein a predetermined volume $V_H$ of liquid while the rotor is rotating, each of the liquid-capturing holes having a mouth thereon, at least some portion of the mouth of each liquid-capturing hole lying radially outboard of the circular locus defined by the points of maximum distance, the number N of holes and the volume $V_H$ of each hole satisfying the relationship:

$$N \cdot V_H + V_C \geqq n \cdot V_R,$$

where n is an integer less than or equal to M, each liquid capturing hole being disposed between two adjacent cavities such that a radius extending from the axis of rotation to the axis of any one of the holes bisects the arc of length S between the cavities adjacent to said one of the holes.

3. The rotor of claim 2 wherein at least some portion of each hole communicates with the containment annulus.

* * * * *